United States Patent [19]

Washburn

[11] Patent Number: 4,719,722

[45] Date of Patent: Jan. 19, 1988

[54] KNIFE SHARPENER AND HOLDER

[75] Inventor: Robert M. Washburn, Mahtomedi, Minn.

[73] Assignee: Advertising Unlimited, Inc., Sleepy Eye, Minn.

[21] Appl. No.: 366,691

[22] Filed: Apr. 8, 1982

[51] Int. Cl.[4] ..... B23F 21/03

[52] U.S. Cl. ..... 51/205 R; 51/205 WG; 76/86

[58] Field of Search ..... 51/204, 205 R, 205 WG, 51/211 R, 211 H, 246, 250, 285; 76/81.3, 82.2, 82, 84, 86; 30/155; D19/72

[56] References Cited

U.S. PATENT DOCUMENTS

| | | | |
|---|---|---|---|
| 2,504,423 | 4/1950 | Johnson et al. | 76/82.2 X |
| 3,601,893 | 8/1971 | Knox | 30/155 X |
| 4,166,404 | 9/1979 | Almog | D19/72 X |
| 4,231,194 | 11/1980 | Glesser | 51/211 R |
| 4,259,815 | 4/1981 | Kuban | 51/205 R |

*Primary Examiner*—E. R. Kazenske
*Assistant Examiner*—Willmon Fridie, Jr.
*Attorney, Agent, or Firm*—Jacobson and Johnson

[57] ABSTRACT

A knife sharpener rod pivotally mounted on a supporting base member whereby it can be angularly positioned for use and rotated into a recess or chamber in the base member for storage. A finger guard is also pivotally attached to the base member.

14 Claims, 6 Drawing Figures

KNIFE SHARPENER AND HOLDER

FIELD OF THE INVENTION

This invention is a household device directed for use to sharpen knives, scissors, etc. and yet which can be conveniently folded up into a compact package to be stored away when not in use.

DESCRIPTION OF THE PRIOR ART

The use of an elongated rod composed of or coated with a suitable material for use as a knife sharpener is well known. Typically, U.S. Pat. Nos. 3,894,362 and 2,674,072 show various forms of knife sharpening rods. In addition, the need for placing the rod or other type of sharpening tool at a suitable angle for most efficient sharpening of the knife blade is shown in the same two patents and also is shown in U.S. Pat. No. 1,223,127. As pointed out in these patents, particularly in the '362 patent, the rod may contain or may be coated with a suitable abrasive material, for example a ceramic dispersed in aluminum oxide and when placed at a suitable angle the knife edge is placed against the rod to make virtual point contact and is drawn across the rod and downward to sharpen the blade. Generally, the angle of the rod is changed to sharpen the other side of the knife edge. The '362 patent shows two separate sharpening rods at suitable angles mounted together on a base member to accommodate the sharpening of opposite sides of a knife.

SUMMARY OF THE INVENTION

This invention provides a knife sharpener rod of the well known variety pivotally mounted on a supporting base member so that the rod can be positioned to a suitable angular location for efficient shapening and, in addition, there is provided a guard to protect the user's hand against accidental slipping of the knife while it is being sharpened. The device is constructed and assembled so that it can be folded up into a compact unit for storage when not in use.

DESCRIPTION OF THE PREFERRED EMBODIMENT

Figure 1:
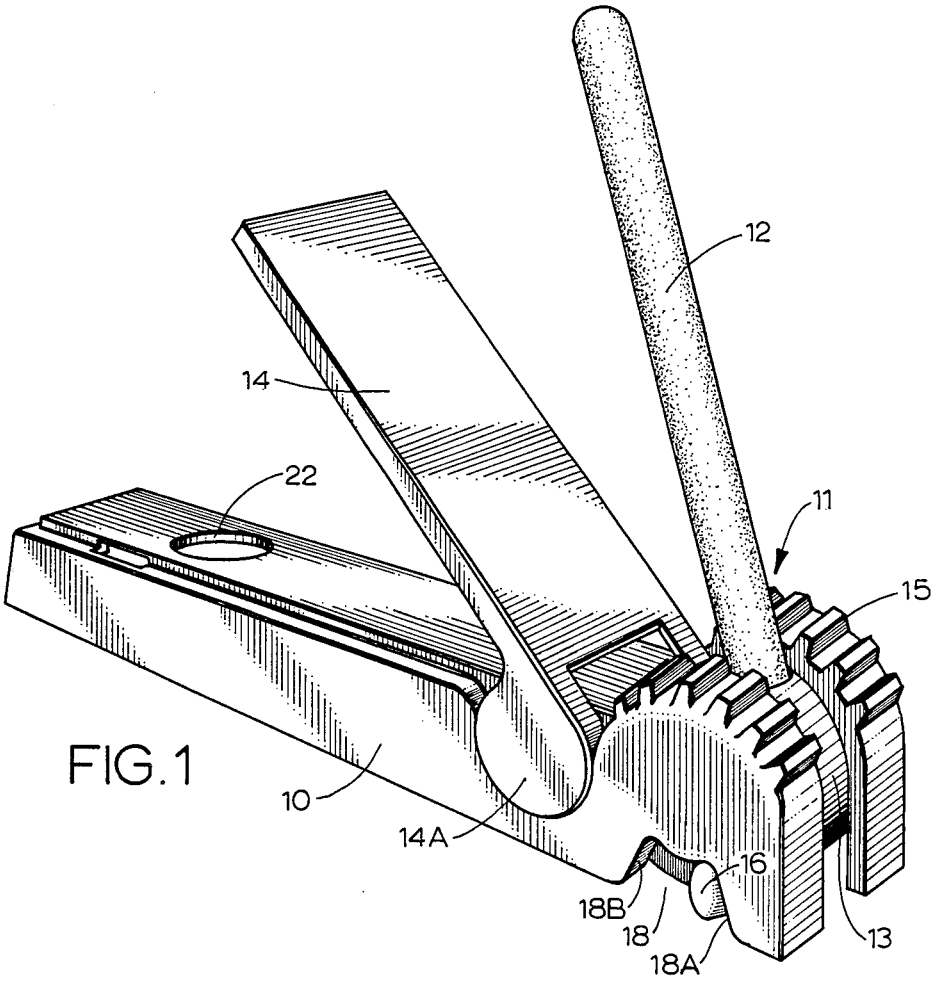
FIG. 1 is a perspective view of an embodiment of the invention showing it assembled and in position for use.
Figure 2:
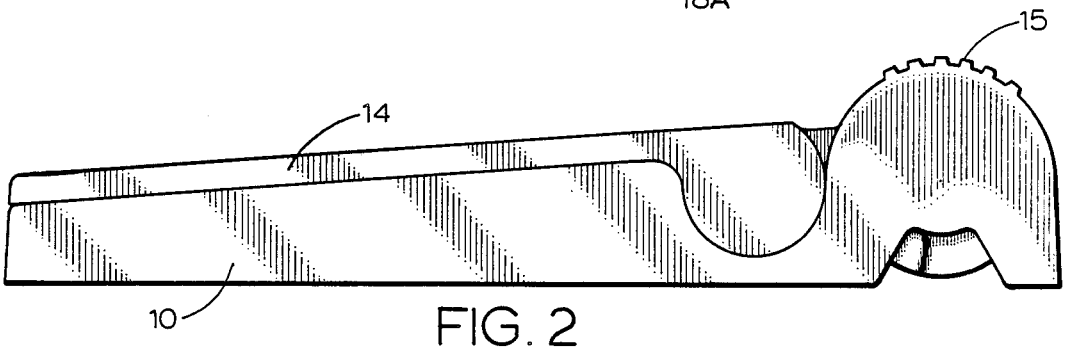
FIG. 2 is a side view of the embodiment shown in FIG. 1 showing it folded into a compact unit for storage.
Figure 4:
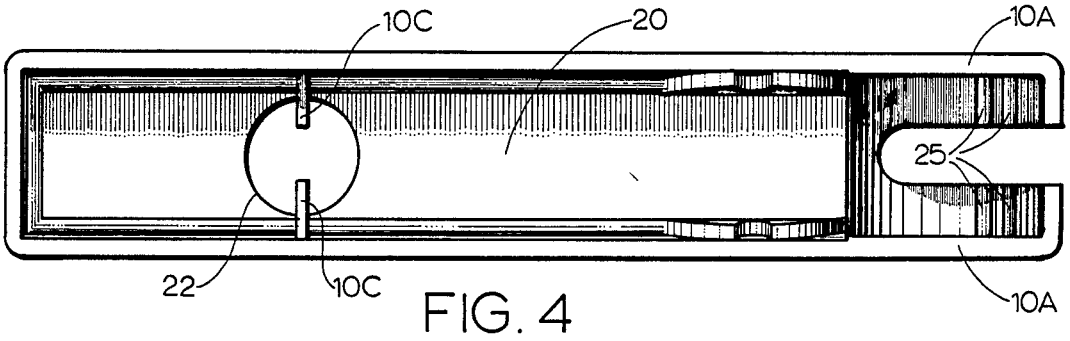
FIG. 4 is a bottom view of the base member.
Figure 6:
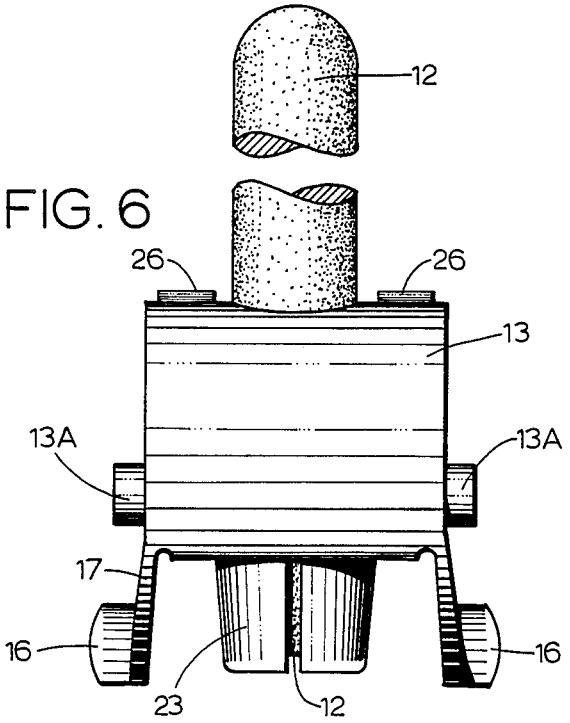
FIG. 6 is a detailed view of the sharpener rod assembly of the embodiment shown in FIG. 1.

As shown in FIG. 1, the knife sharpener and holder comprises in combination, an elongated supporting base member 10, a knife sharpener rod assembly 11 comprising an elongated knife sharpener rod 12 attached to a barrel or wheel 13 which is pivotally attached to the base member 10, and an elongated finger guard 14 which is also pivotally connected to the base member 10. In FIG. 1 the device is shown as it would generally appear when ready for use wherein the base member 10 rests on a flat supporting surface, not shown, and the knife sharpener rod 12 is positioned upwardly at a suitable angle with respect to the base member 10 and the finger guard 14 similarly is at an elevated angular position to protect the user's fingers which normally would be grasping the base member 10 to hold it in place while a knife edge is being brought downwardly on and across the knife sharpener rod 12. A series of ribs or ridges 15 are located on the upper side of the base member 10 at the bottom of the rod 12 so that as the knife reaches the end of the downward stroke during sharpening it is stopped and not likely to slip off and damage the knife edge or damage the surface on which the sharpener is resting. As can be observed in FIG. 1, a dog or lug 16 (preferably one on each side as illustrated in FIG. 6) which is attached to the pivot wheel 13 by a relatively thin arm or tab 17 rests in a groove or slot 18 formed in the bottom of a side wall of the base member 10. The front and rear ends of the slot, 18A and 18B respectively, can constitute stops for the dog 16. In use, the rod 12 then can be pivotally swung to any angle between the two stops. Generally, the stops are located so that the maximum swing of the rod in each direction constitutes a suitable angle for sharpening each side of the knife edge. When the device is not being used, it can be folded up into a compact package for convenient storage as illustrated in FIG. 2. This is done by rod 12 being swung clockwise as viewed in FIG. 1, around until it nests in a recess or chamber 20 on the underside of the base member 10 (FIG. 4). To do this, the dog 16 must be moved so that it can get past stop 18B. This is done merely by manually pushing the dog 16 inwardly a sufficient amount so that as the rod 12 is swung counterclockwise the dog 16 passes the edge of stop 18B. This is possible because the tab or arm 17 which attaches dog 16 to the wheel 13 is made so that it resiliently urges the dog 16 outwardly yet can be compressed sufficiently to enable the dog to be moved inwardly to get past the stop limits. Due to the combination of the material used and its physical structure, arm 17 has a plastic memory or resiliency which enables it to cause dog 16 to snap back outwardly into slot 18 when the rod 12 is removed from the recess under base member 10 and is swung back into the upward position for use.

Figure 3:
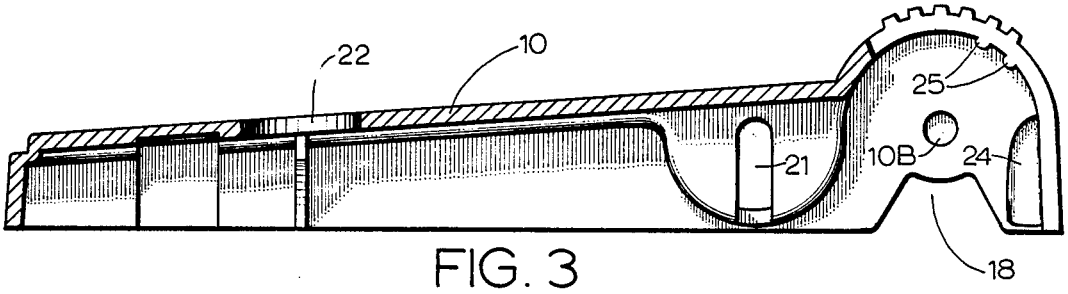
FIG. 3 is sectioned view of the base member of the embodiment shown in FIG. 1.
Figure 5:
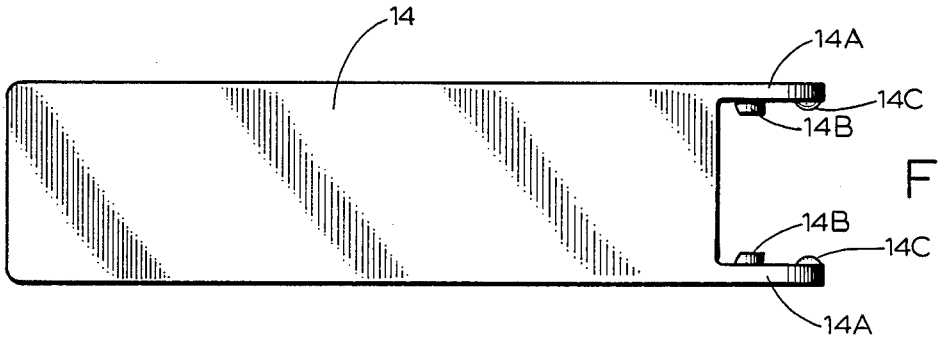
FIG. 5 is a top view of the finger guard of the embodiment shown in FIG. 1.

The construction of finger guard 14 is shown in greater detail in FIG. 5. The main body of the finger guard 14 is an elongated flat piece of some suitable rigid material, preferably plastic, which has a pair of spaced apart oppositely facing ears 14A extending downward from the side edges at one end. On the inner sides of the ears 14A are formed pivot posts 14B which are dimensioned to fit into pivot slots 21 in base member 10 (see FIG. 3). The ears 14A are constructed to have enough resiliency to enable them to be manually spread apart far enough so that when the finger guard is being assembled onto the base member posts 14B will pass over the sides of the base member 10 until they reach slot 21 where they are resiliently urged into and are held in place by ears 14B returning to their unstressed condition. Blisters 14C are formed on the inner surface of ears 14A to frictionally contact the outer surface of base member 10 to hold the finger guard in position when it is pivotally raised.

Base member 10 is similarly made out of some suitable relatively rigid plastic material and has a first section in the form of an elongated inverted channel or trough which defines a chamber or recess 20 at the underside of base member 10. Located in recess 20 extending inward from the side walls of base member 10 are a pair of spaced-apart, opposed ribs 10C which are constructed in a fashion to serve as clips to hold rod 12 in place when it is inserted in the recess 20. An access hole 22 is formed in the top surface of the base member 10 for the convenience of dislodging rod 12 from its storage location in recess 20. At one end of the base member 10 are a pair of spaced-apart, arcuate, oppositely-facing flanges 10A which are extensions of the side walls of the base member 10. In the inside of flanges 10A are formed oppositely facing pivot recesses 10B. As described earlier, slots 21 in the side walls of base member 20 are to receive pivot posts 14B on finger guard 14.

Turning to FIG. 6, rod 12 is attached at one end in some convenient fashion to the wheel 13 and extends radially outward therefrom. For example, rod 12 may be snug fitted and frictionally held in an elongated chamber 23 extending radially part way through the wheel 13. The fit should be snug enough to hold rod 12 in place during normal use but yet permit it to be rotated to make a clean sharpening surface available and be removed for cleaning or replacement when necessary. Jutting out axially from each side of wheel 13 are pivot posts 13A which are suitably dimensioned to fit into the pivot recesses 10B in base member 10. Sufficient resiliency exists in the flanges 10A so that they can be spread far enough apart during assembly to permit pivot wheel 13 to pass between the two flanges 10A until the posts 13A seat in the respective pivot recesses 10B and are held there by the flanges 10A returning to their normal unstressed condition. As described earlier, dogs 16 are attached to wheel 13 via resilient arms 17 which, as shown in FIG. 6, normally urge the dogs outward.

When the rod 12 is rotated to the storage position in chamber 20, resilient arms 17 are pressed inward by flanges 10A. It has been found that if they are pressed too far for too long the arms 17 may lose resiliency. To remedy this, a depression or recess 24 is formed on the inner surface of each flange 10A to relieve some of the inward pressure on the arms 17 when the rod 12 is stored away.

It has also been found that when the rod 12 is swung to its rightmost postion for sharpening (as viewed in FIG. 1) when the knife being sharpened is applied in the proper fashion the rod has a tendency to vibrate excessively. To minimize this, slight ridges or rises 25 are formed on the inner curved surface of base 10 to engage similar ridges 26 formed on the outer surface of the barrel of wheel 13.

I claim:

1. A knife sharpener and holder, comprising:
(a) an elongated base member having an elongated recess;
(b) a single elongated knife sharpener rod;
(c) means for pivotally engaging said base member with said rod;
(d) means for holding the rod in two different angular knife sharpening positions when swung upwardly from the base member, said rod holding means being releasable to permit the rod to be pivotally swung into the base member recess for storage.

2. The device as described in claim 1 in which the recess is in the underside of said base member.

3. The device as described in claim 1 further including resilient clip means in the base member recess for releasably holding the rod when it is inserted into the recess.

4. The device as described in claim 1 further including hand guard means extending at least in part over said base member pivotally engaged with said base member between where the rod engages said base member and an end of said base member.

5. The device as described in claim 4 wherein the hand guard means is pivotally attached to be swung upwardly from and downwardly onto the base member.

6. The device as described in claim 1 in which said means for holding the rod in knife sharpening positions comprises:
(a) slot means in said base member;
(b) dog means for engaging said slot means and free to move between the ends of the slot means;
(c) means resiliently attaching said dog means to the rod pivotal engagement means for normally urging the dog means into engagement with said slot means and being manually compressible to disengage the dog means from the slot means to permit the rod to be swung into the base member recess.

7. The device as described in claim 6 wherein said dog means contacts the ends of said slot means to hold the rod in the knife sharpening positions.

8. The device as described in claim 1 wherein:
(a) said base member has spaced-apart, opposed flanges at one end; and
(b) said rod pivotal engagement means comprises a wheel rotatably held between said base member flanges, said rod being attached to and extending radially from said wheel.

9. The device as described in claim 8 wherein said base member has a gap between said flanges and said rod extends upward through said gap when in knife-sharpening position.

10. The device as described in claim 8 further including a hand guard comprising an elongated piece of rigid protective material having spaced-apart, opposed ears extending downward from its side edges at one end with pivot posts formed on the inside of said ears engaging slots in the side walls of said base member for pivotal attachment to the base member.

11. The device as described in claim 10 wherein the base member recess is located on the underside of the base member and includes clip means attached to the side walls of the base member for holding the rod when it is inserted in the base member recess.

12. The device as described in claim 11 further including an access hole on the upper side of said base member for use to dislodge the rod when held in the recess.

13. The device as described in claim 1 wherein said means for holding the rod in the knife sharpening positions, comprises:
(a) slot means in said bse member;
(b) dog means for engaging said slot means;
(c) means for attaching said dog means to said rod pivotal engagement means and for normally urging said dog means into engagement with said slot means, said rod being in a knife-sharpening position when the dog means is against either end of the slot means.

14. The device as described in claim 13 wherein said means for attaching the dog means to the rod pivotal engagement means is manually compressible to disengage the dog means from the slot means to permit the rod to be swung into the base member recess.

* * * * *